United States Patent [19]

Piesinger

[11] 4,079,381

[45] Mar. 14, 1978

[54] NULL STEERING APPARATUS FOR A MULTIPLE ANTENNA ARRAY ON AN AM RECEIVER

[75] Inventor: Gregory H. Piesinger, Scottsdale, Ariz.

[73] Assignee: Motorola, Inc., Schaumburg, Ill.

[21] Appl. No.: 744,010

[22] Filed: Nov. 22, 1976

[51] Int. Cl.[2] ..... H01Q 3/26

[52] U.S. Cl. ..... 343/100 SA; 343/100 CL; 343/100 LE; 343/854

[58] Field of Search ..... 343/100 SA, 100 CL, 343/100 LE, 854

[56] References Cited

U.S. PATENT DOCUMENTS

| | | | |
|---|---|---|---|
| 3,670,335 | 6/1972 | Hirsch | 343/100 SA |
| 3,763,490 | 10/1973 | Hadley et al. | 343/100 LE X |
| 4,032,922 | 6/1977 | Provencher | 343/100 SA X |

*Primary Examiner*—Maynard R. Wilbur

*Assistant Examiner*—Richard E. Berger

*Attorney, Agent, or Firm*—Eugene A. Parsons

[57] ABSTRACT

Null steering apparatus in a multiple antenna array including means associated with each antenna for separating signals therefrom into in-phase and quadrature components which can be adjusted so that unwanted signals from the array are cancelled and further including circuitry for separating an identifier signal, which is a low level signal substantially in-phase quadrature with the AM signal on the carrier, to produce a reference signal which is subtracted from signals in the feedback loop of the null steering apparatus to form a lobe in the antenna pattern in the direction of the carrier modulated with the AM signal. In this circuit the identifier signal is a PN code signal and the circuitry decodes the PN code signal and shifts the phase of the remaining carrier 90° so that it is a replica of the carrier signal received by the antenna.

7 Claims, 4 Drawing Figures

NULL STEERING APPARATUS FOR A MULTIPLE ANTENNA ARRAY ON AN AM RECEIVER

BACKGROUND OF THE INVENTION

Null steering or adaptive noise cancelling is a procedure which has been known for many years and is described, for example, in such typical articles as "Adaptive Antenna Systems", by B. Widrow et al, Proceedings of the IEEE, Vol. 55, No. 12, December 1967, and "Adaptive Noise Cancelling: Principles and Applications", by B. Widrow et al, Proceedings of the IEEE, Vol 63, No. 12, December 1975. In general, null steering is a technique whereby two or more antenna signals are weighted and summed together to form a composite antenna pattern. The pattern is formed in such a manner as to create antenna pattern nulls in the direction of the jamming signals and lobes in the direction of desired signals. Using null steering techniques, nulls on the order of 50dB can be automatically steered in the direction of a jamming signal.

Using, for example, a four channel null steerer, each antenna signal is split into an in-phase component and a quadrature component with a 90° hybrid circuit or the like. The two signal components are then weighted and summed together along with the signal components from the other antenna weighters, in a final summing circuit. By using a 90° hybrid circuit and weighters, a single phasor (any specific signal on an antenna can be represented by a phasor) on a particular antenna can be shifted to any new phase and amplitude desired. If a jamming signal, or any other undesired signal, is present on two antennas, for example, the null steerer will shift the two signals (phasors) such that they are of equal amplitude and opposite phase. When these two weighted signals are then summed together in the final summing circuit, they will cancel, thereby forming an antenna pattern null in the direction of the jamming signal. The process is similar when the jamming signal is present on all four antennas. The number of independent nulls that can be formed is equal to N-7 where N is the number of antennas.

The values of the weighters are automatically adjusted by feeding back the output of the final summing circuit to a correlator or mixer, which mixes the output with each of the signal components from the antenna, which is nonweighted, thereby creating a correlation voltage. This correlation voltage is integrated and used to drive the specific weighter for that antenna component. The weighters are always driven in such a manner as to minimize the feedback signal. When the feedback signal is completely eliminated, corresponding to forming a complete null, the output of the correlator is zero and the system has fully adapted. A null steerer implemented in this manner will null out all signals as long as the number of signals is equal to or less than N-1.

To prevent nulling of desired signals, a reference signal must be used. Any prior art null steering systems which utilize a reference, simply insert an estimate of the desired signal. This reference, or estimated signal, is then used to subtract off the desired signal present at the output of the final summing circuit, thereby, preventing it from being fed back to the correlators. If the estimated signal differs from the desired signal in phase or content, a null will also be formed in the direction of the desired signal and the desired signal will be lost. Thus, it is essential that the reference signal be extremely accurate.

SUMMARY OF THE INVENTION

The present invention pertains to null steering apparatus for use in conjunction with a multiple antenna array wherein a carrier signal having modulated thereon an AM signal and a relatively low level identifier signal substantially in-phase quadrature with the AM signal are transmitted simultaneously, with the identifier signal being separated from the desired signal in the null steering apparatus and utilized to produce a reference signal substantially the same frequency and phase as the carrier signal, which reference signal is utilized to form a lobe in the antenna pattern in the direction of the carrier having the AM signal thereon in the antenna array. Further, in the present invention the identifier signal may be, for example, a secure PN code which has the properties that it is constantly changing and not predictable. This make it impossible for anyone transmitting a jamming signal to place the correct identifier on his signal. Since an AM radio is an envelope detector and not a phase detector and the identifier is in phase quadrature with the AM signal, AM radios are substantially unaffected by the presence of the low level identifier signal.

It is an object of the present invention to provide new and improved null steering apparatus for use in conjunction with a multiple antenna array connected to an AM radio.

It is a further object of the present invention to provide new and improved null steering apparatus for use in conjunction with a multiple antenna array including a new and improved apparatus and method for providing a reference signal to form a lobe in the antenna pattern in the direction of an AM signal received by an AM receiver.

It is a further object of the present invention to provide new and improved null steering apparatus for AM reception wherein an identifier signal is transmitted with the AM signal, which identifier includes a low level PN code signal substantially in-phase quadrature with the AM signal.

These and other objects of this invention will become apparent to those skilled in the art upon consideration of the accompanying specification, claims and drawings.

BRIEF DESCRIPTION OF THE DRAWINGS

Referring to the drawings.

DESCRIPTION OF THE PREFERRED EMBODIMENT

Figure 1:
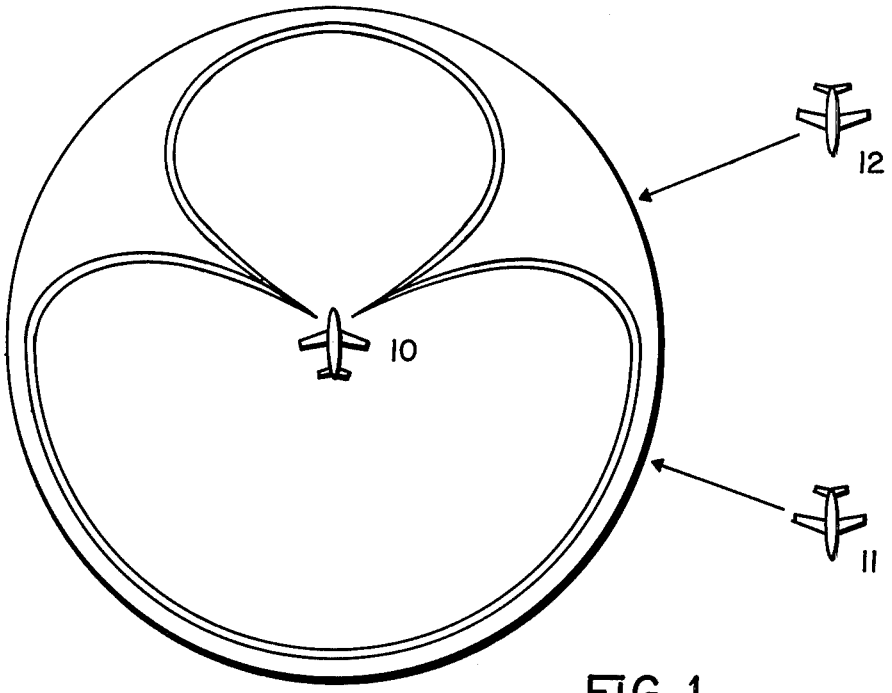
FIG. 1 illustrates a typical antenna pattern for a multiple antenna array incorporating null steering apparatus.

Referring specifically to FIG. 1, an airplane 10 is illustrated carrying a multiple antenna array with null steering apparatus and communications equipment connected thereto. In this specific example, the communications equipment connected to the multiple antenna array is tuned to communicate with a transmitter on a second airplane, designated 11. Jamming signals, for the purpose of frustrating communications between the airplanes 10 and 11, may be transmitted from some source, such as a transmitter on a third airplane 12. The purpose of the multiple antenna array with null steering apparatus is to provide an antenna pattern, typically as shown in FIG. 1, wherein an antenna lobe is directed toward the desired signal from the airplane 11 and an antenna null is directed toward the jamming signal from the airplane 12. In this fashion the jamming signal can be substantially eliminated and the desired signal can be received with very little or no interference. The multiple antenna array with null steering apparatus, located aboard the airplane 10, which provides the antenna pattern illustrated in FIG. 1, is illustrated by the block diagram of FIG. 2. For use in cooperation with the apparatus illustrated in FIG. 2, the transmitter on the airplane 11 is constructed to transmit the identifier signal at the same time that it transmits the desired signal. This identifier signal will be described in more detail in conjunction with FIGS. 2, 3, and 4.

Figure 2:
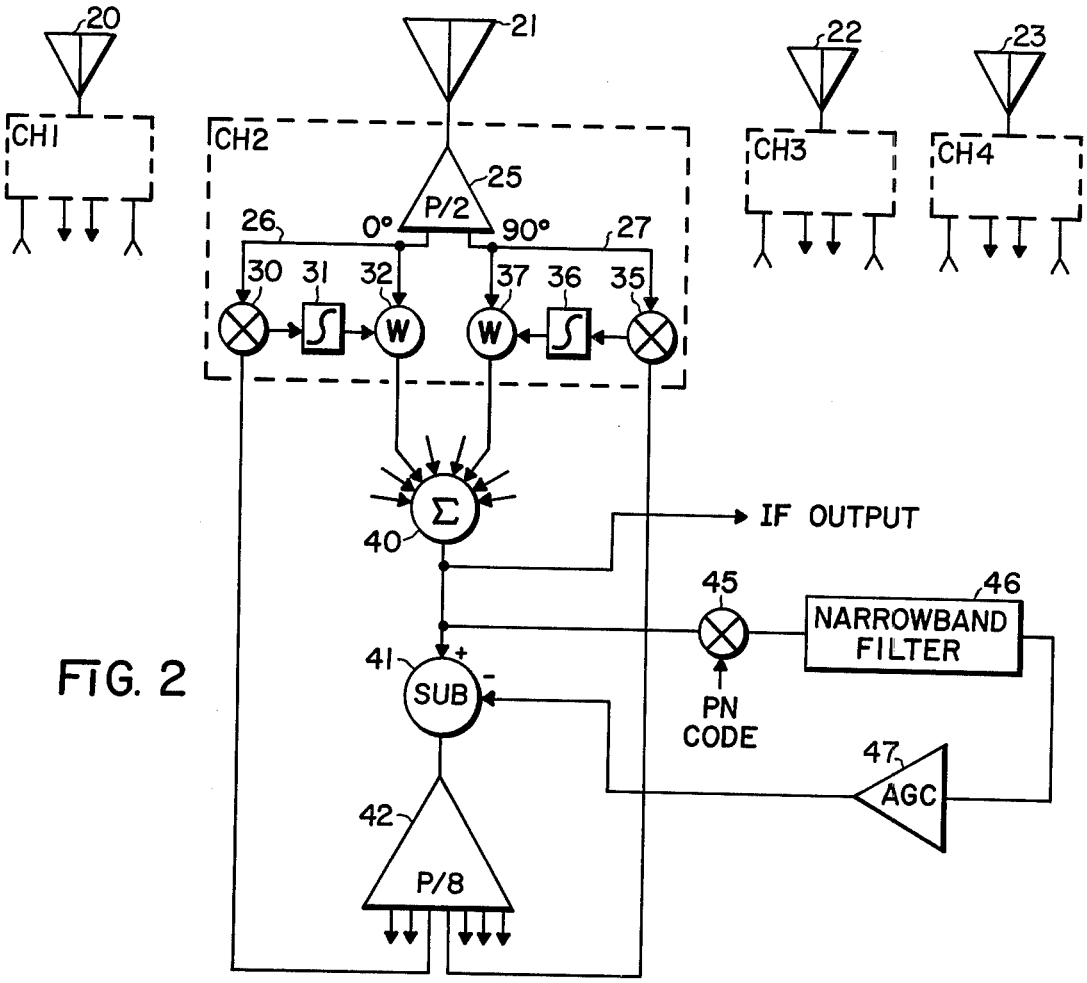
FIG. 2 is a block diagram of a multiple antenna array incorporating null steering apparatus embodying the present invention.

Referring specifically to FIG. 2, a multiple antenna array is illustrated, consisting of four antennas designated 20–23. Any specific signal on any one of the antennas 20–23 can be represented by a phasor and each antenna has associated therewith electronics, designated channel 1 through channel 4, for manipulating the signal so that the phasor has substantially any desired amplitude and phase. Each of the channels 1 through 4 is identical and, therefore, only channel 2 will be described in detail and it should be understood that each of the remaining channels operates in a similar fashion and contains similar apparatus.

A 90° hybrid, or phase splitter, 25 is connected to receive the signals from antenna 21 and supply in-phase and quadrature components thereof on lines 26 and 27, respectively.* The line 26 transmitting the in-phase component, is connected to one input of a correlator, which may be a mixer or multiplier, 30 that provides a signal at an output thereof which is representative of the correlation between the signal applied from the line 26 and a signal applied to a second input of the correlator 30. Output signals from the correlator 30 are integrated in an integrator 31 and applied to a control input of a weighting circuit 32, a second input of which is connected to the line 26. The weighting circuit 32 may be, for example, a variable amplifier or attenuator wherein the signal from the integrator 31 adjusts the amplitude, or weight, of the signal passing through the weighting circuit 32 from the line 26. In a similar fashion, the line 27 is connected to one input of a correlator 35, which correlator 35 has an output connected through a integrator 36 to the control input of a weighting circuit 37. The weighting circuit 37 also has an input connected to the line 27. The correlator 35, integrator 36 and weighting circuit 37 are substantially identical to the correlator 30, integrator 31 and weighting circuit 32, respectively. 6

*It should be understood that circuitry can be interposed between the antennas and the phase splitters to alter the frequency of the incoming signal, e.g., if type circuitry.

The outputs of the weighting circuits 32 and 37, as well as similar outputs from channels 1, 3 and 4, are applied to a summing circuit 40. The summing circuit 40 has a single output which is connected to one input of a subtractor circuit 41 with a single output which is applied through a power splitter 42 to each of the second inputs of the correlators 30, 35, and the two correlators in each of the channels 1, 3 and 4. The output of the summing circuit 40 is also applied as an IF input to an AM communications receiver (not shown). Also, the output of the summing circuit 40 is connected to one input of a decoder, or mixer, 45. A second input of the decoder 45 is connected to receive an internally generated PN code (which generator is not illustrated). An output of the decoder 45 is connected through a narrow band filter 46 to an AGC amplifier 47. The output signal from the summing circuit 40 is shifted in phase by the filter 46 and AGC amplifier 47 and applied to a second input of the subtracting circuit 41. The phase shift in the filter and amplifier circuitry is sufficient to provide a reference signal in-phase with the AM carrier.

Figure 3:
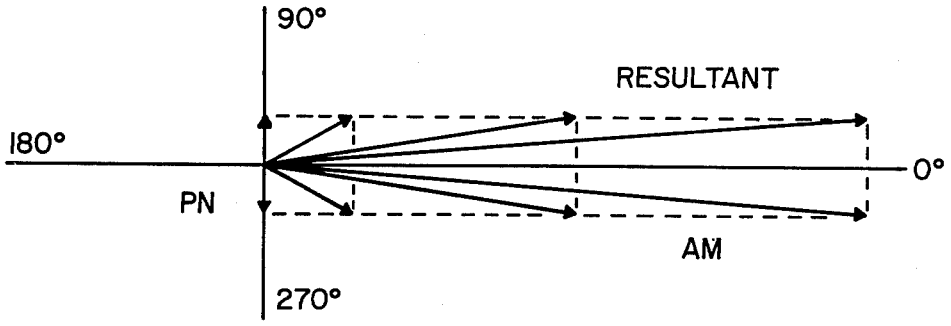
FIG. 3 is a vector, or phasor, diagram illustrating the relationship of the AM signal and the identifier signal.
Figure 4:
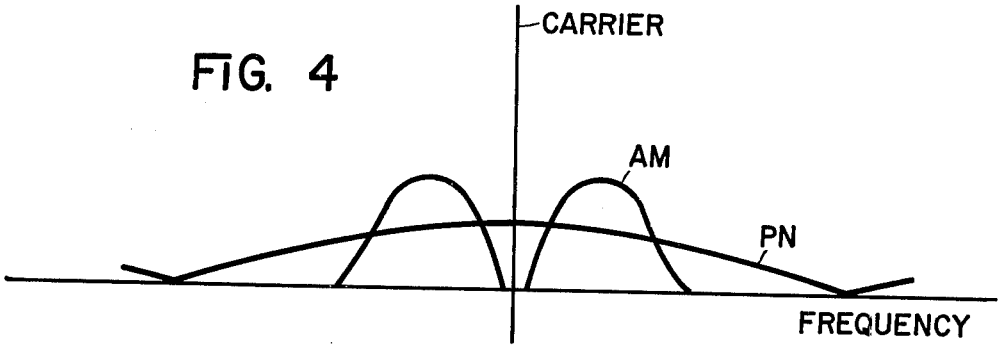
FIG. 4 is a frequency distribution or spectrum curve illustrating the frequency relationship of various components of the transmitted signal.

In the operation of the specific embodiment illustrated, it should first be understood that the transmitter at the airplane 11 transmits an AM signal, or amplitude modulated carrier, and simultaneously the transmitted carrier is modulated with a low level identifier signal substantially in phase quadrature with the AM signal, which in this specific embodiment is a secure PN code. The phase and frequency relationship of the AM signal and the PN code are illustrated in FIGS. 3 and 4, respectively.

Signals from the antenna 21 are split into an in-phase component and a quadrature component in the phase splitter 25. The two signal components are then weighted by the weighting circuits 32 and 37 and summed together, along with the signals from the other antenna weighters, in the summing circuit 40. The values of the weighting circuits 32 and 37 are automatically adjusted by feeding back the output of the summing circuit 40 through the subtractor 41 and power splitter 42 to the correlators 30 and 35. The feedback signal is correlated with the non-weighted signal from the phase splitter 25 to create a correlation voltage which is integrated and used to drive the weighting circuits 32 and 37. The weighting circuits 32 and 37 are always driven in such a manner as to minimize the feedback signal. When the feedback signal is completely eliminated, corresponding to forming a complete null, the output of the correlators 30 and 35 is zero and the system has fully adapted. A null steerer implemented in this manner will null out all signals as long as the number of signals is equal to or less than N-1, where N is the number of antennas.

A signal present at the antenna can be represented by a phasor and the phase splitter 25 and weighting circuits 32 and 37 are utilized to shift the phasor to any phase and amplitude desired. For example, if a jamming signal is present on antennas 20 and 21, the null steerer will shift the two signals (phasors) such that they are of equal amplitude and opposite phase. When these two weighted signals are then summed together in the summing circuit 40, they will cancel, thereby forming an antenna pattern null in the direction of the jamming signal, as illustrated in FIG. 1. The process is similar when the jamming signal is present on all four antennas.

The reference signal applied to the subtracting circuit 41 prevents nulling out the AM signal. By subtracting the reference signal in the subtracting circuit 41, the AM signal is not fed back to the correlators 30 and 35 and, since the AM signal is not present at the correlators 30 and 35, no null will be formed thereon and a lobe will be formed in the antenna pattern in the direction of the AM signal. The important point to be understood is that the system has fully adapted only when the feedback signal is zero. Therefore, if the power output from the AGC amplifier 47, i.e., the reference signal power output, equals the AM signal output power from the summing circuit 40 the output of the subtracting circuit 41, which is the feedback signal to the correlators 30 and 35, will be equal to zero and a lobe will be formed on the AM signal.

The bandwidth of the filter 46 is just wide enough to pass the frequency uncertainty of the carrier. The decoder or mixer 45 receives the carrier modulated with the PN code and injects an internally generated PN code which is exactly the same as the transmitted PN code so that only a CW (continuous wave) signal in phase quadrature to the carrier is available at the output thereof. Any system attempting to decode the transmitted signal without the correct PN code will have a signal at the output of the decoder with a frequency spectrum similar to white noise, as illustrated in FIG. 4 and labeled PN. Since the uncoded signal has a very wide bandwidth, it will not pass through the narrow band filter 46 and the uncoded signal will eventually be nulled out in the null steering apparatus. If the internally generated PN code applied to the mixer 45 is the correct code, the CW signal at the output of the mixer 45 will be a signal at the same frequency as the transmitted carrier and the signal will pass readily through the filter 46. Since the CW signal applied to the filter 46 is in phase quadrature with the transmitted carrier, once the phase of this signal is shifted 90° in the filter 46 and amplifier 47 the output signal will have the same frequency and be in phase with the transmitted carrier. This reference signal, which is a replica of the transmitted carrier is then applied to the subtracting circuit 41. While the terms "transmitted carrier" and "carrier signal" are used in this disclosure, it should be understood that the terms are meant to include not only the carrier actually transmitted but any other signals, e.g., IF signals, to which the transmitted signal is converted before being applied to the present circuit.

Since the PN code, or identifier, is placed in phase quadrature on the carrier and at a relatively low level and since the AM receiver is an envelope detector and not a phase detector, the AM receiver is unaffected by the presence of the low level identifier or PN code signal. This can be seen by the vector or phasor diagram in FIG. 3 where it is clear that the amplitude of the in-phase signal (the AM signal along the 0° axis) the substantially unaffected by the PN code signal in quadrature therewith. The code rate is selected so that most of the spectral energy passes through the narrow band IF filter of the AM radio. Since most of the energy present in an AM signal is contained in the carrier, it is not necessary to include the modulation present on the carrier in the reference signal applied to the subtractor 31. Since the reference signal is a CW signal of the exact frequency and phase as the transmitted carrier of the desired AM signal, the carrier of the AM signal can be subtracted from the output of the summing circuit 40 and therefore be eliminated from the feedback signal to the correlators 30 and 35. The amplitude modulation on the carrier will be present in the feedback signal along with the transmitted PN code but these components of the desired signal do not contain sufficient energy to form a null.

Therefore, through the use of the present null steering apparatus a reference signal is produced which is a CW signal of the same frequency and phase as the carrier of the AM signal and is utilized to form a lobe in the antenna pattern in the direction of the AM signal. It will be apparent to those skilled in the art that different identifier signals, which are in phase quadrature with the carrier, might be utilized and that different apparatus might be utilized for picking off the identifier signal and for generating a CW signal having the same frequency and phase as the carrier. While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. In a multiple antenna array, null steering apparatus for reception of a carrier signal having modulated thereon an AM signal and a relatively low level identifier signal substantially in phase quadrature with the AM signal, said null steering apparatus comprising:

a. feedback means associated with each antenna in said array for adjusting the amplitude and phase of signals therein so that unwanted signals from the array are cancelled;

b. reference signal producing means coupled to said feedback means for picking off the identifier signal and utilizing the identifier signal to generate a reference signal having the same frequency and phase as the carrier signal; and c. compensating means coupled to said feedback means for utilizing the reference signal to form a lobe in the antenna pattern in the direction of the carrier having the AM signal thereon.

2. In a multiple antenna array, null steering apparatus for reception of a carrier signal having modulated thereon an AM signal and a relatively low level identifier signal substantially in phase quadrature with the carrier signal, said null steering apparatus comprising:

a. feedback means associated with each antenna in said array for separating signals coupled from the antenna, representable as phasors, into in-phase and quadrature components and adjusting the in-phase and quadrature components to alter the amplitude and phase of the phasors so that unwanted signals from the array are cancelled;

b. reference signal producing means coupled to said feedback means for picking off the identifier signal and utilizing the identifier signal to generate a reference signal having the same frequency and phase as the carrier signal; and c. compensating means coupled to said feedback means for utilizing the reference signal to form a lobe in the antenna pattern in the direction of the carrier having the AM signal thereon.

3. Null steering apparatus as claimed in claim 2 wherein the identifier signal is a PN code signal.

4. In a multiple antenna array, null steering apparatus for reception of a carrier signal having modulated thereon an AM signal and a relatively low level PN code signal substantially in phase quadrature with the carrier signal, said null steering apparatus comprising:

a. feedback means associated with each antenna in said array for separating signals from the antenna, representable as a phasor, into in-phase and quadrature components and adjusting the in-phase and quadrature components to alter the amplitude and phase of the phasor so that unwanted signals from the array are cancelled;

b. PN decoder means coupled to said feedback means for picking off the PN code signal and converting the PN code signal to a CW signal;

c. narrowband filter means connected to said PN decoder means for receiving and passing the CW signal;

d. amplifier means connected to said filter means for receiving the CW signal therefrom and shifting the phase thereof, in conjunction with said filter means, substantially 90° into phase into the carrier; and e. compensating means coupled to said feedback means for utilizing the phase shifted CW signal to form a lobe in the antenna pattern in the direction of the carrier having the AM signal thereon.

5. Null steering apparatus as claimed in claim 4 wherein the PN decoder means includes a mixer having one input connected to receive the PN code signal from the feedback means and a second input connected to have applied thereto a PN code generated at the null steering apparatus for removing the PN code from the carrier and leaving only a carrier shifted from the AM carrier by 90°.

6. In a communications system including a transmitter for transmitting a carrier signal, having modulated thereon an AM signal and a relatively low level PN code signal substantially in phase quadrature with the carrier signal, and a receiver having a multiple antenna array attached thereto, a method of null steering the array comprising the steps of:

a. separating signals from each antenna, representable as a phasor, into in-phase and quadrature components and adjusting the amplitude of the components to vary the amplitude and phase of the phasors so that unwanted signals from the array, are cancelled;

b. separating the PN code signal from the AM signal and decoding the PN code signal to provide a CW signal substantially in phase quadrature with the transmitted carrier signal;

c. shifting the phase of the CW signal substantially 90° into phase with the transmitted carrier signal; and d. utilizing the phase shifted CW signal in adjusting the amplitude of the components to form a lobe in the antenna pattern in the direction of the carrier signal having the AM signal thereon.

7. In a communication system including a transmitter for transmitting a carrier signal having modulated thereon an AM signal and a receiver having a multiple antenna array attached thereto, a method of null steering the array comprising the steps of:

a. transmitting an identifier signal with the AM signal, which identifier includes a relatively low level signal modulating the carrier signal substantially in phase quadrature with the carrier signal;

b. separating signals from each antenna, representable as a phasor, into in-phase and quadrature components and adjusting the amplitude of the components to vary the amplitude and phase of the phasors so that unwanted signals from the array are cancelled;

c. separating the identifier signal from the AM signal and utilizing the identifier signal to generate a reference signal having the same frequency and phase as the carrier signal; and d. utilizing the reference signal in adjusting the amplitude of the components to form a lobe in the antenna pattern in the direction of the carrier signal having the AM signal thereon.

* * * * *